US009162152B2

(12) United States Patent
Jimenez Schreck

(10) Patent No.: US 9,162,152 B2
(45) Date of Patent: Oct. 20, 2015

(54) STUFFED ANIMAL WITH STORAGE POUCH FOR PLASTIC BAGS OR THE LIKE

(71) Applicant: Elvira Jimenez Schreck, Chicago, IL (US)

(72) Inventor: Elvira Jimenez Schreck, Chicago, IL (US)

( * ) Notice: Subject to any disclaimer, the term of this patent is extended or adjusted under 35 U.S.C. 154(b) by 0 days.

(21) Appl. No.: 14/270,500

(22) Filed: May 6, 2014

(65) Prior Publication Data

US 2014/0335755 A1 Nov. 13, 2014

Related U.S. Application Data

(60) Provisional application No. 61/821,860, filed on May 10, 2013.

(51) Int. Cl.
*A63H 3/00* (2006.01)

(52) U.S. Cl.
CPC ..... *A63H 3/003* (2013.01)

(58) Field of Classification Search
USPC ..... 446/71–76, 98, 268, 369; D3/216, 217; 224/153, 158, 160, 627, 637
See application file for complete search history.

(56) References Cited

U.S. PATENT DOCUMENTS

| | | | | |
|---|---|---|---|---|
| 4,662,550 | A * | 5/1987 | O'Donnell | 224/657 |
| 4,889,512 | A * | 12/1989 | Burnett et al. | 446/72 |
| 5,003,725 | A * | 4/1991 | Maddox | 47/39 |
| 5,288,261 | A * | 2/1994 | Spector | 446/267 |
| 5,326,300 | A * | 7/1994 | Sonders | 446/74 |
| 5,975,392 | A * | 11/1999 | Miller et al. | 224/651 |
| 6,056,618 | A * | 5/2000 | Larian | 446/73 |
| 6,343,968 | B1 * | 2/2002 | Louie et al. | 446/72 |
| 6,434,769 | B1 * | 8/2002 | Koenig | 5/636 |
| D624,748 | S * | 10/2010 | Gold et al. | D3/216 |
| 8,152,587 | B1 * | 4/2012 | Brown | 446/73 |
| D694,001 | S * | 11/2013 | Thomas-Ramsey | D3/217 |
| 8,758,075 | B2 * | 6/2014 | Rubinfeld | 446/73 |
| 8,944,876 | B2 * | 2/2015 | Hengel et al. | 446/73 |
| 2006/0089076 | A1 * | 4/2006 | Jacobson | 446/71 |
| 2007/0232186 | A1 * | 10/2007 | Shamah | 446/369 |
| 2008/0220688 | A1 * | 9/2008 | Cuisinier | 446/73 |
| 2009/0108036 | A1 * | 4/2009 | Moore et al. | 224/153 |
| 2012/0329358 | A1 * | 12/2012 | Cupid | 446/73 |
| 2013/0137338 | A1 * | 5/2013 | Rubinfeld | 446/73 |
| 2015/0004868 | A1 * | 1/2015 | Islam | 446/73 |

* cited by examiner

*Primary Examiner* — Kurt Fernstrom
(74) *Attorney, Agent, or Firm* — Wood, Phillips, Katz, Clark & Mortimer

(57) ABSTRACT

A storage pouch is adapted for use with an animal body comprising a trunk having a waist and a shoulder. The storage pouch comprises a generally tubular shape garment comprising a continuous fabric panel defining an interior storage space having a top end opening and a bottom end opening. A zippered opening in the panel provides selective access to the storage space. A circular waistband is at the top end opening and is receivable on the trunk waist. First and second straps each have opposite ends secured to a front and a back of the waistband to suspend the garment from the animal body shoulder. A circular cuff is at the bottom end opening. A pair of semi-circular fabric pieces is secured to the cuff to provide a slot opening into the storage space. Articles to be stored can be inserted through the zippered opening and withdrawn through the slotted opening.

20 Claims, 5 Drawing Sheets

STUFFED ANIMAL WITH STORAGE POUCH FOR PLASTIC BAGS OR THE LIKE

CROSS-REFERENCE TO RELATED APPLICATIONS

This application claims priority of provisional application No. 61/821,860, filed May 10, 2013.

FEDERALLY SPONSORED RESEARCH OR DEVELOPMENT

Not Applicable.

MICROFICHE/COPYRIGHT REFERENCE

Not Applicable.

FIELD OF THE INVENTION

This invention relates to a storage pouch for plastic bags and the like and, more particularly, to a storage pouch adapted to be worn on a plush animal body.

BACKGROUND

Prior to the 1980's, paper shopping bags were used for carrying groceries or other purchased goods. In the 1980's, grocery chains began to replace paper shopping bags with plastic bags. The plastic bags have become common for carrying groceries home from the store. While the use of plastic bags has increased in popularity, beyond groceries to virtually any type of purchased goods, disposal of the plastic bags has become of concern. While some bags are made of biodegradable materials, most do not readily decompose. Advantageously, the plastic bags will be reused or recycled.

Prior to reuse or recycling, a consumer may need to store the plastic bags for some period of time. Also, if the bags will be reused, any such storage should advantageously allow for ready access to the plastic bags. While one method for doing so is to store numerous plastic bags in another plastic bag, or the like, doing so is unsightly and can overflow.

The storage pouch disclosed herein provides for environmentally friendly storage of plastic bags for reuse or recycling.

SUMMARY

In accordance with one aspect of the invention, there is disclosed a storage pouch for use with an animal body comprising a trunk having a waist and a shoulder. The storage pouch comprises a generally tubular shape garment comprising a continuous fabric panel defining an interior storage space having a top end opening and a bottom end opening. A zippered opening in the panel provides selective access to the storage space. A circular waistband is at the top end opening and is receivable on the trunk waist. First and second straps each have opposite ends secured to a front and a back of the waistband to suspend the garment from the animal body shoulder. A circular cuff is at the bottom end opening. A pair of semi-circular fabric pieces is secured to the cuff to provide a slot opening into the storage space. Articles to be stored can be inserted through the zippered opening and withdrawn through the slotted opening.

It is a feature that a draw cord selectively tightens the waistband about the trunk waist. The draw cord may comprise a cord lock stopper.

It is another feature that the cuff may include a draw cord to selectively close the bottom end opening. The draw cord may comprise a cord lock stopper.

It is a further feature that the tubular shaped garment comprises a pantaloon and further comprises a second bottom opening, a second circular cuff at the second bottom opening, and a second pair of semi-circular fabric pieces secured to the second circular cuff to provide a second slot opening.

It is a further feature that the fabric panel comprises a cotton or bamboo fabric panel.

It is yet another feature that the straps may form an X shape at the back of the waistband.

It is yet a further feature that the draw cord selectively closes the waistband upon removal of the stored receptacle from the animal body.

It is yet an additional feature that the panel may comprise an invisible zipper defining the zippered opening.

There is disclosed in accordance with another aspect of the invention a storage apparatus comprising a plush animal body comprising a trunk having a waist and a shoulder. First and second arms extend outwardly from the shoulder. A head extends upwardly from the shoulder. A generally tubular shaped garment comprises a continuous fabric panel defining an interior storage space having a top end opening and a bottom end opening. A zippered opening in the panel provides selective access to the storage space. A circular waistband is at the top end opening receivable on the trunk waist. First and second straps each have opposite ends secured to a front and back of the waistband to suspend the garment from the plush animal body shoulder. A circular cuff is at the bottom end opening. A pair of semi-circular fabric pieces is secured to the cuff to provide a slot opening into the storage space. Articles to be stored can be inserted through the zippered opening and withdrawn through the slot opening or the zippered opening.

Other features and advantages will be apparent from a review of the entire specification, including the appended claims and drawings.

DETAILED DESCRIPTION

Figure 1:
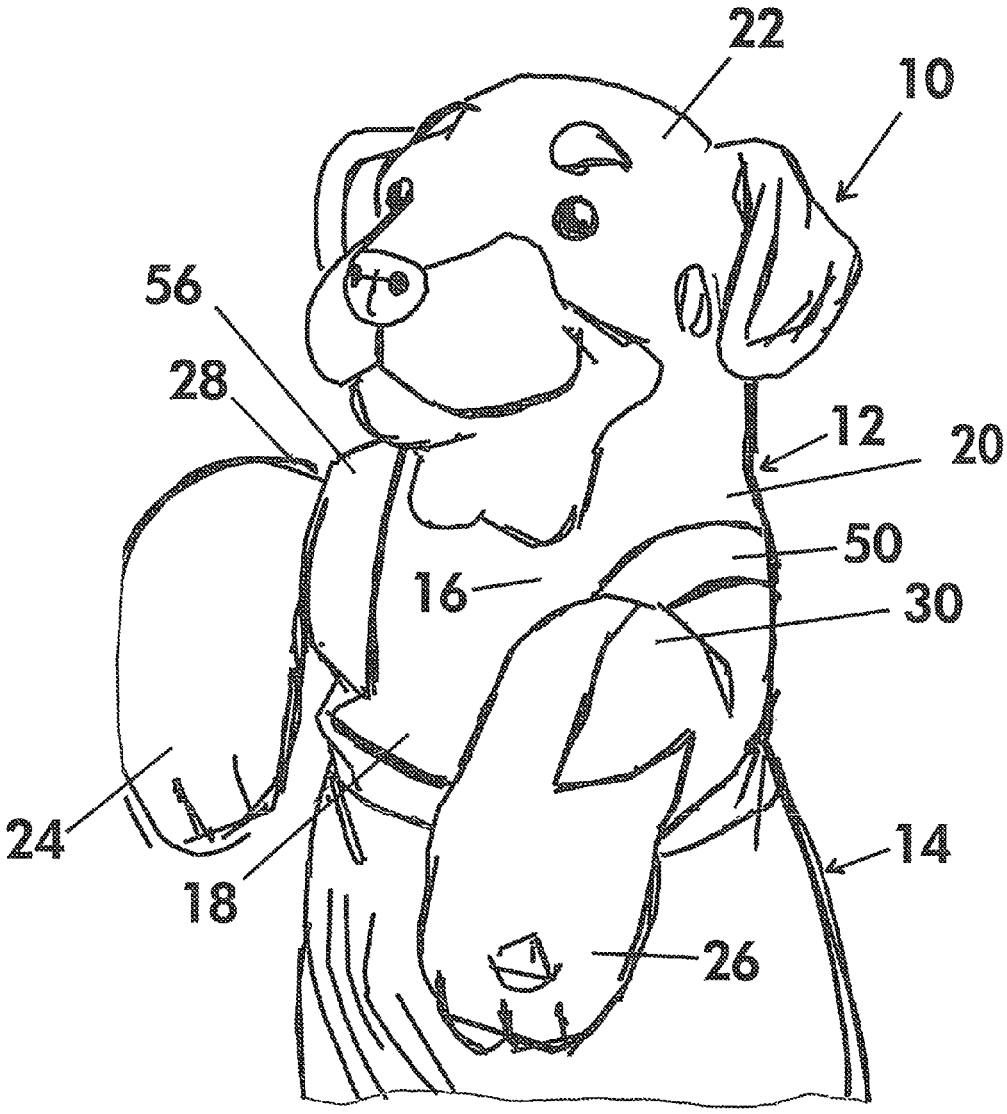
FIG. 1 is a perspective view of a storage apparatus comprising a plush animal body and a storage pouch.
Figure 2:
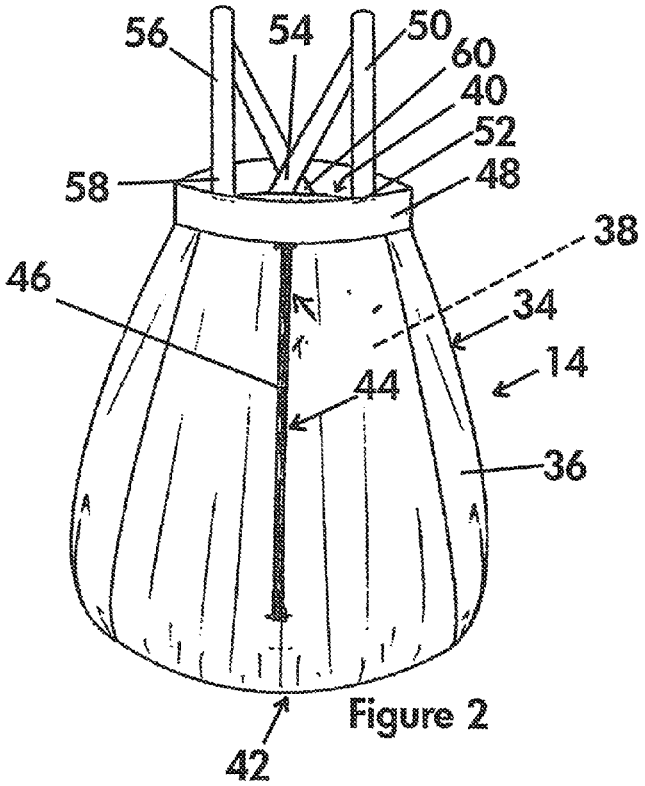
FIG. 2 is a front elevation view of the storage pouch of FIG. 1.
Figure 3:
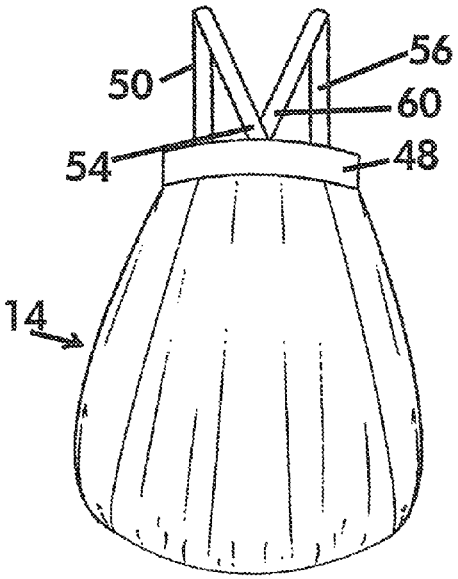
FIG. 3 is a rear elevation view of the storage pouch of FIG. 1.

Referring initially to FIG. 1, a storage apparatus 10 comprises a plush animal body 12 and a storage pouch 14. The storage apparatus 10 provides for environmentally friendly and aesthetically pleasing storage of plastic bags for reuse or recycling, and allows for easy dispensing of the bags. However, the storage apparatus 10 is not limited to use in connection with storage of plastic bags.

Figure 10:
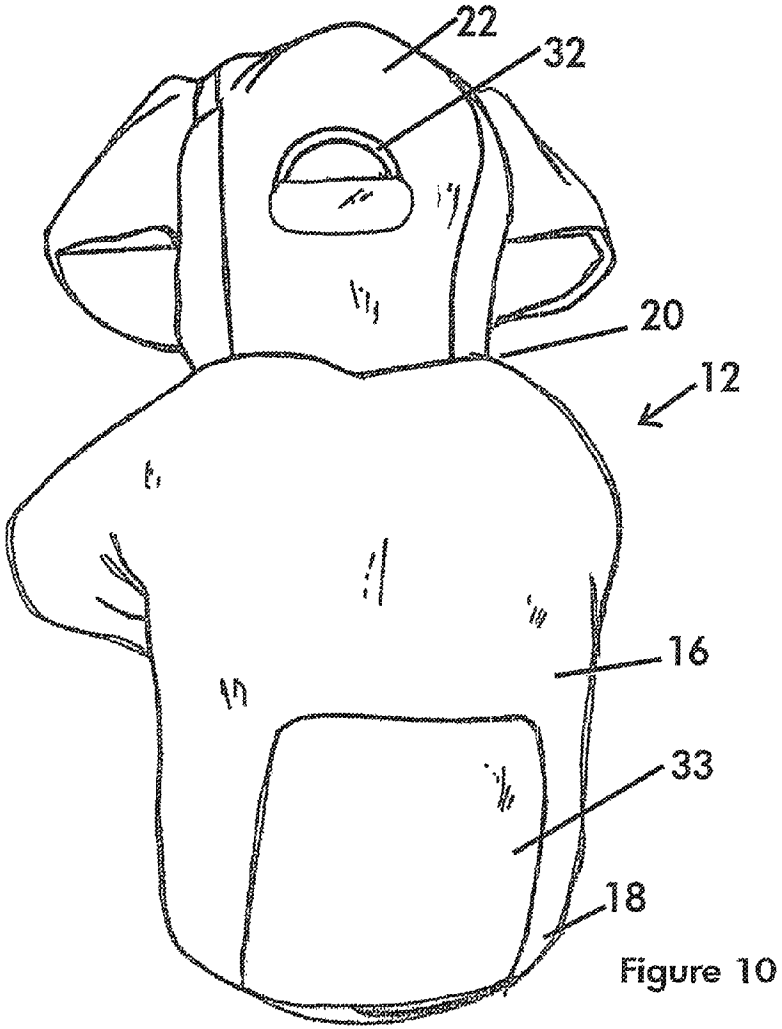
FIG. 10 is a rear view of the plush animal body.

The plush animal body 12 comprises a trunk 16 having a waist 18 and a shoulder 20. A head 22 extends upwardly from the shoulder 20. First and second arms 24 and 26 extend outwardly from the shoulder 20. The arms 24 and 26 widen at an upper end 28 and 30, respectively, for holding the storage pouch 14, as discussed below. A hook 32, see FIG. 10, may be secured onto the back of the head 22 to hang the storage apparatus 10. The plush animal body 12 may include a sound module box (not shown) received in a pocket 33, see FIG. 10, to record and/or play back audio, as is known.

The plush animal body 12 may take any known form such as a dog, cat or other animal, mascot, or even a human, as necessary or desired. The invention is not limited to any particular form of plush animal body, but rather the use of a storage pouch adapted to be received and held onto the animal body as part of a storage apparatus as described herein. Likewise, while the animal body comprises a plush animal body, the animal body could be of various different materials and constructions.

Figure 4:
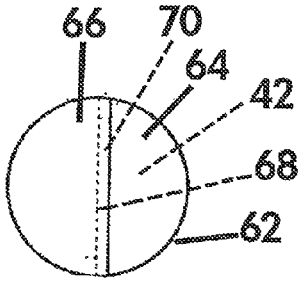
FIG. 4 is a bottom view of the storage pouch of FIG. 2.
Figure 5:
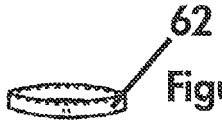
FIG. 5 is a perspective view of a circular cuff used on the storage pouch of FIG. 2.
Figure 6:
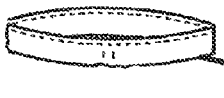
FIG. 6 is a perspective view of a waistband used on the storage pouch of FIG. 2.
Figure 7:
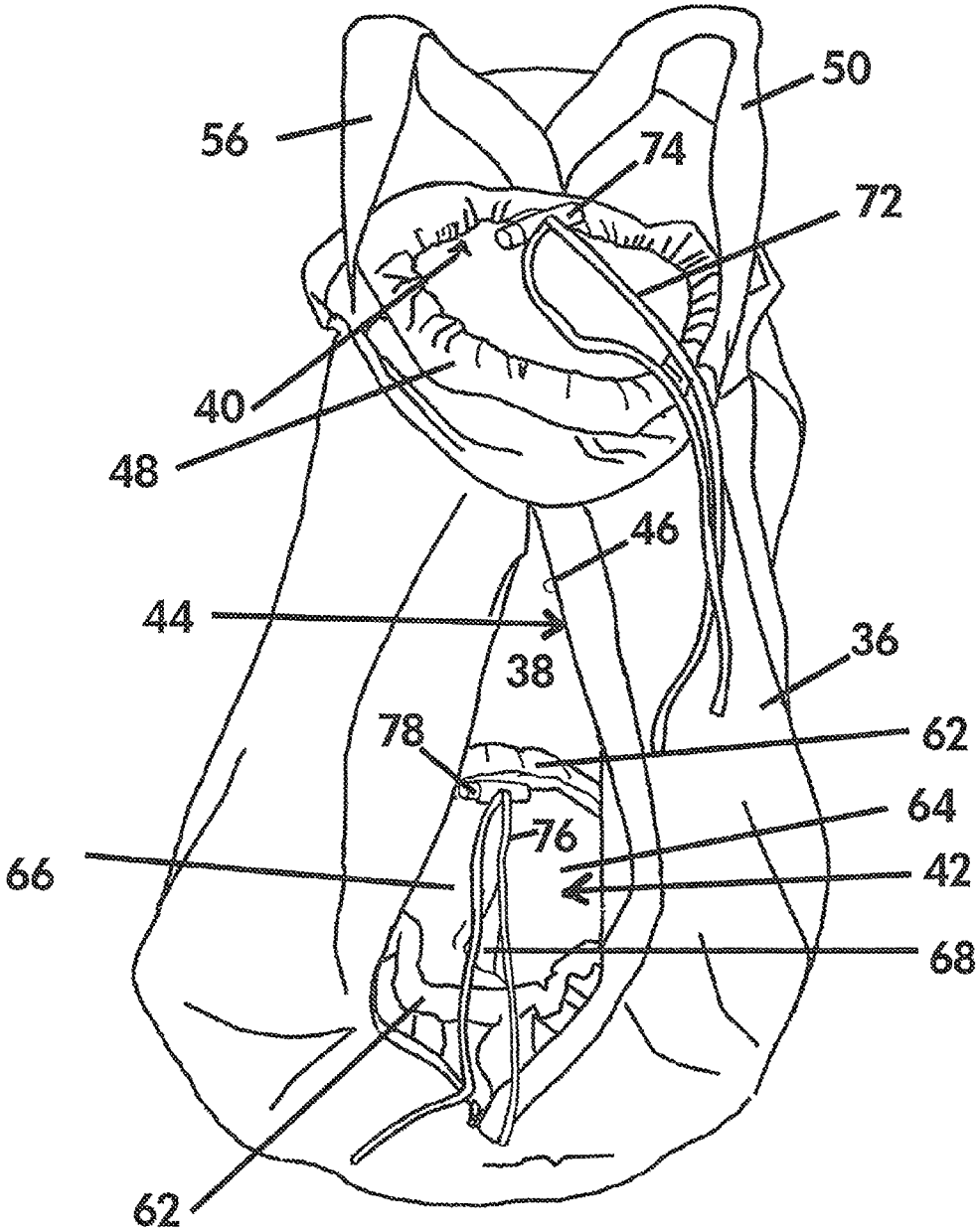
FIG. 7 is a front perspective view illustrating an interior space of the storage pouch of FIG. 2.

Referring to FIGS. 2-6, the pouch 14 is in the form of a generally tubular shaped garment 34 comprising a continuous fabric panel 36 defining an interior storage space 38, see also FIG. 7, having a top end opening 40 and a bottom end opening 42. A zippered opening 44 in the panel 36 provides selective access to the storage space 38. A conventional invisible zipper 46 selectively closes the zippered opening 44. A circular waistband 48, see also FIG. 6, is sewn at the top opening 40 of the panel 36. The waistband 48 is of a size to be received on the trunk waist 18, see FIG. 1.

A first strap 50 has a first end 52 sewn to a front of the waistband 48 and a second end 54 sewn to a rear of the waistband 48. A second strap 56 has a first end 58 sewn to the front of the waistband 48 and a second end 60 sewn to the rear of the waistband 48. In the illustrated embodiment, the straps 50 and 56 cross proximate the second ends 54 and 60 to form an X shape, similar to conventional suspenders. Indeed, the straps 50 and 56 are receivable on the plush animal body shoulder 20, as shown in FIG. 1. The arm wider upper ends 30 and 28 serve to prevent the straps 50 and 56, respectively, from falling off of the shoulder 20.

A circular cuff 62, see FIGS. 4 and 5, is secured to the panel 36 at the bottom end opening 42. A pair of semi-circular fabric pieces 64 and 66 is secured to the cuff 60 to provide a slot opening 68 into the storage space 38. Particularly, the fabric pieces 64 and 66 are slightly larger than an exact semi-circle to provide an overlapping region 70.

Referring to FIG. 7, a first draw cord 72 extends through the waistband 48 to selectively tighten the waistband 48 around the waist 18. A cord lock stopper 74 of any known design is used to restrain the first draw cord 72 to maintain a desired size of the waistband 48.

A second draw cord 76 extends through the cuff 62 and includes a second cord lock stopper 78. The second draw cord 76 is used to selectively close the bottom end opening 42.

In an exemplary embodiment, the pouch 14 is about twenty-seven inches in height from the top of the straps 50 and 52 to the cuff 62. The waistband 48 is about twenty-two inches around and two inches in height. The panel 36 is about nineteen inches in height with a thirteen inch invisible zipper 46. The cuff 62 provides a bottom opening of about five inches in diameter. As is apparent, these dimensions are intended for illustration and are not intended to limit the invention. The garment 34 may be formed of a cotton sateen fabric, a bamboo fabric or could be other types of fabric, as desired.

In usage, the pouch 14 is fitted on the plush animal body 12, as shown in FIG. 1. The assembled storage apparatus 10 can be hung using the hook 32.

The storage pouch 14 is designed to make it easy to store plastic bags, or the like, for recycling, by opening up the invisible zipper 46 for insertion through the zippered opening 44, see FIG. 7, into the storage space 38. The bags can be dispensed by pulling the plastic bags through the open bottom slot 68, see also FIG. 4. Additionally, the second draw cord 76 can be used to close off the bottom opening 42 for more permanent storage without dispensing. Likewise, by removing the pouch 14 from the plush animal body 12, the first draw cord 72 can be used to close the top opening 40 so that the pouch 14 can be used as a garment laundry bag for washing and drying delicate items.

Figure 8:
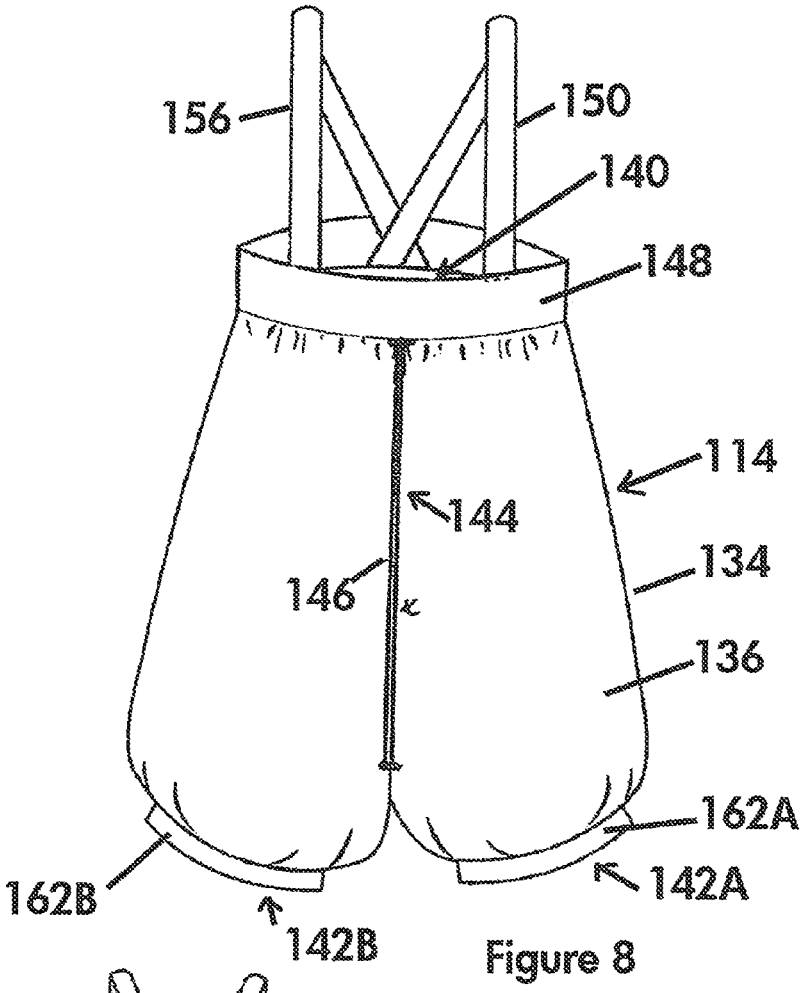
FIG. 8 is a front perspective view of an alternative storage pouch in the form of a storage pantaloon.
Figure 9:
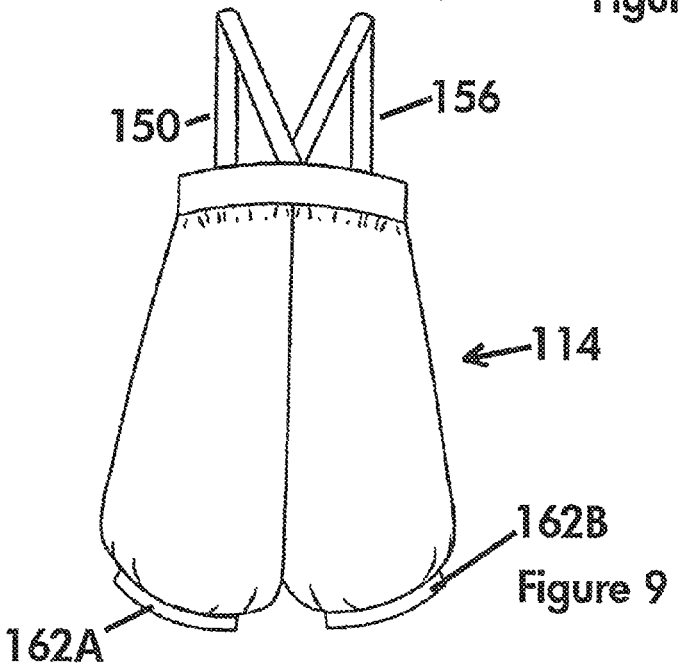
FIG. 9 is a rear elevation view of the storage pantaloon of FIG. 8.

Referring to FIGS. 8 and 9, a pouch 114 according to an alternative embodiment of the invention is illustrated. In this embodiment, the pouch 114 is adapted as a pantaloon garment 134 for use with a male plush animal body. In general, the pantaloon pouch 114 is similar to the pouch 14, discussed above. As a result, similar numbering is used except being in a 100 series. Therefore, the items are not described in detail herein to the extent that they are similar.

The principal difference with the pantaloon garment 134 is that the panel 136 includes two bottom openings 142A and 142B, each closed by a cuff 162A and 162B, respectively. Each of the cuffs 162A and 162B includes semi-circular panels similar to that shown in FIG. 4. Likewise, each of the cuffs 162A and 162B includes a draw cord and cord lock stopper, similar to that discussed relative to the pouch 14. As such, the recyclable bags or the like can be dispensed through either bottom opening 142A or 142B In all other respects, usage of the pantaloon pouch 114 is similar to that with the pouch 114, discussed above.

It will be appreciated by those skilled in the art that there are many possible modifications to be made to the specific forms of the features and components of the disclosed embodiments while keeping within the spirit of the concepts disclosed herein. Accordingly, no limitations to the specific forms of the embodiments disclosed herein should be read into the claims unless expressly recited in the claims. Although a few embodiments have been described in detail above, other modifications are possible.

The invention claimed is:

1. A storage pouch for use with an animal body comprising a trunk having a waist and a shoulder, comprising:

a generally tubular shaped garment comprising a continuous fabric panel defining an interior storage space having a top end opening and a bottom end opening, a zippered opening in the panel providing selective access to the storage space, a circular waistband at the top end opening receivable on the animal body waist, first and second straps each having opposite ends secured to a front and a back of the waistband to suspend the garment from the animal body shoulder, a circular cuff at the bottom end opening, and a pair of semicircular fabric pieces secured to the cuff to provide a slot opening into the storage space, wherein articles to be stored can be inserted through the zippered opening and withdrawn through the slot opening.

2. The storage pouch of claim 1 further comprising a draw cord to selectively tighten the waistband about the animal body waist.

3. The storage pouch of claim 2 wherein the draw cord comprises a cord lock stopper.

4. The storage pouch of claim 1 wherein the cuff includes a draw cord to selectively close the bottom end opening.

5. The storage pouch of claim 4 wherein the draw cord comprises a cord lock stopper.

6. The storage pouch of claim 1 wherein the tubular shaped garment comprises a pantaloon and further comprising a second bottom opening, a second circular cuff at the second bottom opening, and a second pair of semicircular fabric pieces secured to the second circular cuff to provide a second slot opening.

7. The storage pouch of claim 1 wherein the fabric panel comprises a cotton or bamboo fabric panel.

8. The storage pouch of claim 1 wherein the straps form an X shape at the back of the waistband.

9. The storage pouch of claim 1 wherein the draw cord selectively closes the waistband upon removal of the storage receptacle from the animal body.

10. The storage pouch of claim 1 wherein the panel comprises an invisible zipper defining the zippered opening.

11. A storage apparatus comprising:

a plush animal body comprising a trunk having a waist and a shoulder, first and second arms extending outwardly from the shoulder, and a head extending upwardly from the shoulder; and a generally tubular shaped garment comprising a continuous fabric panel defining an interior storage space having a top end opening and a bottom end opening, a zippered opening in the panel providing selective access to the storage space, a circular waistband at the top end opening receivable on the trunk waist, first and second straps each having opposite ends secured to a front and a back of the waistband to suspend the garment from the plush animal body shoulder, a circular cuff at the bottom end opening, and a pair of semicircular fabric pieces secured to the cuff to provide a slot opening into the storage space, wherein the articles to be stored can be inserted through the zippered opening and withdrawn through the slot opening.

12. The storage apparatus of claim 11 wherein the waistband comprises a first draw cord to selectively tighten the waistband about the trunk waist and the cuff includes a second draw cord to selectively close the bottom end opening.

13. The storage apparatus of claim 12 wherein the draw cords each comprise a cord lock stopper.

14. The storage apparatus of claim 11 wherein the tubular shaped garment comprises a pantaloon and further comprising a second bottom opening, a second circular cuff at the second bottom opening, and a second pair of semicircular fabric pieces secured to the second circular cuff to provide a second slot opening.

15. The storage apparatus of claim 11 wherein the fabric panel comprises a cotton or bamboo fabric panel.

16. The storage apparatus of claim 11 wherein the straps form an X shape at the back of the waistband.

17. The storage apparatus of claim 11 wherein the first draw cord selectively closes the waistband upon removal of the storage receptacle from the plush animal body.

18. The storage apparatus of claim 11 wherein the panel comprises an invisible zipper defining the zippered opening.

19. The storage apparatus of claim 11 wherein the arms widen proximate the shoulder to retain the straps on the shoulder.

20. The storage apparatus of claim 11 further comprising a hook on the plush animal body to hang the storage receptacle.

* * * * *